US009153368B2

(12) United States Patent
Ye et al.

(10) Patent No.: US 9,153,368 B2
(45) **Date of Patent: *Oct. 6, 2015**

(54) SOFT MAGNETIC POWDER

(75) Inventors: Zhou Ye, Lerberget (SE); Hanna Staffansson, Sundsvall (SE)

(73) Assignee: HOGANAS AB (PUBL), Hoganas (SE)

( * ) Notice: Subject to any disclaimer, the term of this patent is extended or adjusted under 35 U.S.C. 154(b) by 242 days.

This patent is subject to a terminal disclaimer.

(21) Appl. No.: 13/996,846

(22) PCT Filed: Dec. 19, 2011

(86) PCT No.: PCT/EP2011/073212

§ 371 (c)(1),
(2), (4) Date: Sep. 19, 2013

(87) PCT Pub. No.: WO2012/084801

PCT Pub. Date: Jun. 28, 2012

(65) Prior Publication Data

US 2014/0085039 A1 Mar. 27, 2014

Related U.S. Application Data

(60) Provisional application No. 61/436,725, filed on Jan. 27, 2011.

(30) Foreign Application Priority Data

Dec. 23, 2010 (DK) ..... 2010 70587

(51) Int. Cl.

| | |
|---|---|
| ***H01F 1/24*** | (2006.01) |
| ***H01F 41/02*** | (2006.01) |
| ***B22F 1/02*** | (2006.01) |
| ***H01F 1/22*** | (2006.01) |
| ***C22C 33/02*** | (2006.01) |
| ***H01F 3/08*** | (2006.01) |

(52) U.S. Cl.

CPC .. *H01F 1/22* (2013.01); *B22F 1/02* (2013.01); *C22C 33/0228* (2013.01); *C22C 33/0264* (2013.01); *H01F 1/24* (2013.01); *H01F 3/08* (2013.01); *H01F 41/0246* (2013.01)

(58) Field of Classification Search

CPC ..... H10F 1/24; H10F 27/255; H10F 3/08; B22F 1/02

USPC ..... 252/62.55; 148/104, 105; 428/403, 404; 419/35, 39, 19

See application file for complete search history.

(56) References Cited

U.S. PATENT DOCUMENTS

| | | | |
|---|---|---|---|
| 1,818,596 | A | 8/1931 | Zimmerman |
| 4,177,089 | A | 12/1979 | Bankson |
| 5,063,011 | A | 11/1991 | Rutz et al. |
| 5,595,609 | A | 1/1997 | Gay |
| 6,309,748 | B1 | 10/2001 | Lashmore et al. |
| 6,348,265 | B1 | 2/2002 | Jansson et al. |
| 6,372,348 | B1 | 4/2002 | Hanejko et al. |
| 6,756,118 | B2 | 6/2004 | Aichele et al. |
| 6,903,641 | B2 | 6/2005 | Kondo et al. |
| 2001/0019771 | A1 | 9/2001 | Elgelid et al. |
| 2004/0061582 | A1 | 4/2004 | Kondo et al. |

FOREIGN PATENT DOCUMENTS

| | | | | |
|---|---|---|---|---|
| DE | 34 39 397 | A1 | | 1/1986 |
| EP | 1 246 209 | B1 | | 10/2006 |
| JP | 51-89198 | | | 8/1976 |
| JP | 2002-170707 | A | | 6/2002 |
| JP | 2003-124016 | | * | 4/2003 |
| JP | 2003-124016 | A | | 4/2003 |

OTHER PUBLICATIONS

Translation for JP 2003-124016, Apr. 25, 2003.*

International Search Report (PCT/ISA/210) issued on Feb. 6, 2012, by the European Patent Office as the International Searching Authority for International Application No. PCT/EP2011/073212.

Written Opinion (PCT/ISA/237) issued on Feb. 6, 2012, by the European Patent Office as the International Searching Authority for International Application No. PCT/EP2011/073212.

* cited by examiner

*Primary Examiner* — Carol M Koslow

(74) *Attorney, Agent, or Firm* — Buchanan Ingersoll & Rooney P.C.

(57) ABSTRACT

A composite iron-based powder suitable for soft magnetic applications such as inductor cores. Also, a method for producing a soft magnetic component and the component produced by the method.

15 Claims, No Drawings

SOFT MAGNETIC POWDER

FIELD OF THE INVENTION

The present invention concerns a soft magnetic composite powder material for the preparation of soft magnetic components as well as the soft magnetic components which are obtained by using this soft magnetic composite powder. Specifically the invention concerns such powders for the preparation of soft magnetic components materials working at high frequencies, the components suitable as inductors or reactors for power electronics.

BACKGROUND OF THE INVENTION

Soft magnetic materials are used for various applications, such as core materials in inductors, stators and rotors for electrical machines, actuators, sensors and transformer cores. Traditionally, soft magnetic cores, such as rotors and stators in electric machines, are made of stacked steel laminates. Soft magnetic composites may be based on soft magnetic particles, usually iron-based, with an electrically insulating coating on each particle. By compacting the insulated particles optionally together with lubricants and/or binders using the traditionally powder metallurgy process, soft magnetic components may be obtained. By using the powder metallurgical technique it is possible to produce such components with a higher degree of freedom in the design, than by using the steel laminates as the components can carry a three dimensional magnetic flux and as three dimensional shapes can be obtained by the compaction process.

The present invention relates to an iron-based soft magnetic composite powder, the core particles thereof being coated with a carefully selected coating rendering the material properties suitable for production of inductors through compaction of the powder followed by a heat treating process.

An inductor or reactor is a passive electrical component that can store energy in form of a magnetic field created by the electric current passing through said component. An inductors ability to store energy, inductance (L) is measured in henries (H). Typically an inductor is an insulated wire winded as a coil. An electric current flowing through the turns of the coil will create a magnetic field around the coil, the filed strength being proportional to the current and the turns/length unit of the coil. A varying current will create a varying magnetic field which will induce a voltage opposing the change of current that created it.

The electromagnetic force (EMF) which opposes the change in current is measured in volts(V) and is related to the inductance according to the formula;

$$v(t)32\ L\mathrm{d}i(t)/\mathrm{dt}$$

(L is inductance, t is time, v(t) is the time-varying voltage across the inductor and i(t) is the time-varying current.)

That is; an inductor having an inductance of 1 henry produces an EMF of 1 volt when the current through the inductor changes with 1 ampere/second.

Ferromagnetic- or iron-core inductors use a magnetic core made of a ferromagnetic or ferrimagnetic material such as iron or ferrite to increase the inductance of a coil by several thousand by increasing the magnetic field, due to the higher permeability of the core material.

The magnetic permeability, μ, of a material is an indication of its ability to carry a magnetic flux or its ability to become magnetised. Permeability is defined as the ratio of the induced magnetic flux, denoted B and measured in newton/ampere*meter or in volt*second/meter$^2$, to the magnetising force or filed intensity, denoted H and measured in amperes/meter, A/m. Hence magnetic permeability has the dimension volt*second/ampere*meter. Normally magnetic permeability is expressed as the relative permeability $\mu_r=\mu/\mu_0$, relative to the permeability of the free space, $\mu_0=4*\eta*10^{-7}$ Vs/Am. Permeability may also be expressed as the inductance per unit length, henries/meter.

Magnetic permeability does not only depend on material carrying the magnetic flux but also on the applied electric field and the frequency thereof. In technical systems it is often referred to the maximum relative permeability which is maximum relative permeability measured during one cycle of the varying electrical field.

An inductor core may be used in power electronic systems for filtering unwanted signals such as various harmonics. In order to function efficiently an inductor core for such application shall have a low maximum relative permeability which implies that the relative permeability will have a more linear characteristic relative to the applied electric filed, i.e. stable incremental permeability, $\mu_\Delta$ (as defined according to $\Delta B=\mu_\Delta*\Delta H$), and high saturation flux density. This enables the inductor to work more efficiently in a wider range of electric current, this may also be expressed as that the inductor has "good DC-bias". DC-bias may be expressed in terms of percentage of maximum incremental permeability at a specified applied electrical field, e.g. at 4 000 A/m. Further low maximum relative permeability and stable incremental permeability combined with high saturation flux density enables the inductor to carry a higher electrical current which is inter alia beneficial when size is a limiting factor, a smaller inductor can thus be used.

One important parameter in order to improve the performance of soft magnetic component is to reduce its core loss characteristics. When a magnetic material is exposed to a varying field, energy losses occur due to both hysteresis losses and eddy current losses. The hysteresis loss is proportional to the frequency of the alternating magnetic fields, whereas the eddy current loss is proportional to the square of the frequency. Thus at high frequencies the eddy current loss matters mostly and it is especially required to reduce the eddy current loss and still maintaining a low level of hysterisis losses. This implies that it is desired to increase the resistivity of magnetic cores.

In the search for ways of improving the resistivity different methods have been used and proposed. One method is based on providing electrically insulating coatings or films on the powder particles before these particles are subjected to compaction. Thus there are a large number of patent publications which teach different types of electrically insulating coatings. Examples of published patents concerning inorganic coatings are the U.S. Pat. Nos. 6,309,748, 6,348,265 and 6,562,458. Coatings of organic materials are known from e.g. the U.S. Pat. No. 5,595,609. Coatings comprising both inorganic and organic material are known from e.g. the U.S. Pat. Nos. 6,372,348 and 5,063,011 and the DE patent publication 3,439,397, according to which publication the particles are surrounded by an iron phosphate layer and a thermoplastic material. European Patent EP1246209B1 describes a ferromagnetic metal based powder wherein the surface of the metal-based powder is coated with a coating consisting of silicone resin and fine particles of clay minerals having layered structure such as bentonite or talc.

U.S. Pat. No. 6,756,118B2 reveals a soft magnetic powder metal composite comprising a least two oxides encapsulating powdered metal particles, the at least two oxides forming at least one common phase.

The patent application JP2002170707A describes an alloyed iron particle coated with a phosphorous containing layer, the alloying elements may be silicon, nickel or aluminium. In a second step the coated powder is mixed with a water solution of sodium silicate followed by drying. Dust cores are produced by moulding the powder and heat treat the moulded part in a temperature of 500-1000° C.

Sodium silicate is mentioned in JP51-089198 as a binding agent for iron powder particles when producing dust cores by moulding of iron powder followed by heat treating of the moulded part.

In order to obtain high performance soft magnetic composite components it must, also be possible to subject the electrically insulated powder to compression moulding at high pressures as it is often desired to obtain parts having high density. High densities normally improve the magnetic properties. Specifically high densities are needed in order to keep the hysterisis losses at a low level and to obtain high saturation flux density. Additionally the electrical insulation must withstand the compaction pressures needed without being damaged when the compacted part is ejected from the die. This in turn means that the ejection forces must not be too high.

Furthermore, in order to reduce the hysterisis losses, stress releasing heat treatment of the compacted part is required. In order to obtain an effective stress release the heat treatment should preferably be performed at a temperature above 300° C. and below a temperature, where the insulating coating will be damaged, about 700° C., in an atmosphere of for example nitrogen, argon or air.

The present invention has been done in view of the need for powder cores which are primarily intended for use at higher frequencies, i.e. frequencies above 2 kHz and particularly between 5 and 100 kHz, where higher resistivity and lower core losses are essential. Preferably the saturation flux density shall be high enough for core downsizing. Additionally it should be possible to produce the cores without having to compact the metal powder using die wall lubrication and/or elevated temperatures. Preferably these steps should be eliminated.

In contrast to many used and proposed methods, in which low core losses, are desired, it is an especial advantage of the present invention that it is not necessary to use any organic binding agent in the powder composition, which powder composition is later compacted in the compaction step. The heat treatment of the green compact can therefore be performed at higher temperature without the risk that the organic binding agent decomposes; a higher heat treatment temperature will also improve the flux density and decrease core losses. The absence of organic material in the final, heat treated core also allows that the core can be used in environments having elevated temperatures without risking decreased strength due to softening and decomposition of an organic binder and improved temperature stability is achieved.

OBJECTS OF THE INVENTION

An object of the invention is to provide a new iron-based composite powder comprising a core of a pure iron powder the surface thereof coated with a new composite electrical insulated coating. The new iron based composite powder being especially suited to be used for production of inductor cores for power electronics.

Another object of the invention is to provide a method for producing such inductor cores.

Still another object of the invention is to provide an inductor core having "good" DC-bias, low core losses and high saturation flux density.

SUMMARY OF THE INVENTION

At least one of these objects is accomplished by:

A coated iron-based powder, the coating comprising a first phosphorous containing layer and a second layer containing a combination of alkaline silicate and particles of clays containing defined phyllosilicates. According to an embodiment the coating is constituted of these two layers alone.

A method for producing a sintered inductor core comprising the steps of:

a) providing a coated iron powder as above, b) compacting the coated iron powder, optionally mixed with a lubricant, in a uniaxial press movement in a die at a compaction pressure between 400 and 1200 MPa c) ejecting the compacted component from the die.

d) heat treating the ejected component at a temperature up to 700° C.

A component, such as an inductor core, produced according to above.

DETAILED DESCRIPTION OF THE INVENTION

The iron-based powder is preferably a pure iron powder having low content of contaminants such as carbon or oxygen. The iron content is preferably above 99.0% by weight, however it may also be possible to utilise iron-powder alloyed with for example silicon. For a pure iron powder, or for an iron-based powder alloyed with intentionally added alloying elements, the powders contain besides iron and possible present alloying elements, trace elements resulting from inevitable impurities caused by the method of production. Trace elements are present in such a small amount that they do not influence the properties of the material. Examples of trace elements may be carbon up to 0.1%, oxygen up to 0.3%, sulphur and phosphorous up to 0.3% each and manganese up to 0.3%.

The particle size of the iron-based powder is determined by the intended use, i.e. which frequency the component is suited for. The mean particle size of the iron-based powder, which is also the mean size of the coated powder as the coating is very thin, may be between 20 to 300 μm. Examples of mean particle sizes for suitable iron-based powders are e.g. 20-80 μm, a so called 200 mesh powder, 70-130 μm, a 100 mesh powder, or 130-250 μm, a 40 mesh powder.

The first phosphorous containing coating which is normally applied to the bare iron-based powder may be applied according to the methods described in U.S. Pat. No. 6,348,265. This means that the iron or iron-based powder is mixed with phosphoric acid dissolved in a solvent such as acetone followed by drying in order to obtain a thin phosphorous and oxygen containing coating on the powder. The amount of added solution depends inter alia on the particle size of the powder; however the amount shall be sufficient in order to obtain a coating having a thickness between 20 to 300 nm.

Alternatively, it would be possible to add a thin phosporous containing coating by mixing an iron-based powder with a solution of ammonium phosphate dissolved in water or using other combinations of phosphorous containing substances and other solvents. The resulting phosphorous containing coating cause an increase in the phosphorous content of the iron-based powder of between 0.01 to 0.15%.

The second coating is applied to the phosphorous coated iron-based powder by mixing the powder with particles of a clay or a mixture of clays containing defined phyllosilicate and a water soluble alkaline silicate, commonly known as water glass, followed by a drying step at a temperature between 20-250° C. or in vacuum. Phyllosilicates constitutes the type of silicates where the silicontetrahedrons are connected with each other in the form of layers having the formula $(Si_2O_5^{2-})_n$. These layers are combined with at least one octahedral hydroxide layer forming a combined structure. The octahedral layers may for example contain either aluminium or magnesium hydroxides or a combination thereof. Silicon in the silicontetrahedral layer may be partly replaced by other atoms. These combined layered structures may be electroneutral or electrically charged, depending on which atoms are present.

It has been noticed that the type of phyllosilicate is of vital importance in order to fulfill the objects of the present invention. Thus, the phyllosilicate shall be of the type having uncharged or electroneutral layers of the combined silicon-tetrahedral- and hydroxide octahedral-layer. Examples of such phyllosilicates are kaolinite present in the clay kaolin, pyrophyllite present in phyllite, or the magnesium containing mineral talc. The mean particle size of the clays containing defined phyllosilicates shall be below 15, preferably below 10, preferably below 5 μm, even more preferable below 3 μm. The amount of clay containing defined phyllosilcates to be mixed with the coated iron-based powder shall be between 0.2-5%, preferably between 0.5-4%, by weight of the coated composite iron-based powder.

The amount of alkaline silicate calculated as solid alkaline silicate to be mixed with the coated iron-based powder shall be between 0.1-0.9% by weight of the coated composite iron-based powder, preferably between 0.2-0.8% by weight of the iron-based powder. It has been shown that various types of water soluble alkaline silicates can be used, thus sodium, potassium and lithium silicate can be used. Commonly an alkaline water soluble silicate is characterised by its ratio, i.e. amount of $SiO_2$ divided by amount of $Na_2O$, $K_2O$ or $Li_2O$ as applicable, either as molar or weight ratio. The molar ratio of the water soluble alkaline silicate shall be 1.5-4, both end points included. If the molar ratio is below 1.5 the solution becomes too alkaline, if the molar ratio is above 4 $SiO_2$ will precipitate.

Compaction and Heat Treatment

Before compaction the coated iron-based powder may be mixed with a suitable organic lubricant such as a wax, an oligomer or a polymer, a fatty acid based derivate or combinations thereof. Examples of suitable lubricants are EBS, i.e. ethylene bisstearamide, Kenolube® available from Hoganas AB, Sweden, metal stearates such as zinc stearate or fatty acids or other derivates thereof. The lubricant may be added in an amount of 0.05-1.5% of the total mixture, preferably between 0.1-1.2% by weight. Compaction may be performed at a compaction pressure of 400-1200 MPa at ambient or elevated temperature. After compaction, the compacted components are subjected to heat treatment at a temperature up to 700° C., preferably between 500-690° C. Examples of suitable atmospheres at heat treatment are inert atmosphere such as nitrogen or argon or oxidizing atmospheres such as air.

The powder magnetic core of the present invention is obtained by pressure forming an iron-based magnetic powder covered with a new electrically insulating coating. The core may be characterized by low total losses in the frequency range 2-100 kHz, normally 5-100 kHz, of about less than 28 W/kg at a frequency of 10 kHz and induction of 0.1 T. Further a resistivity, ρ, more than 1000, preferably more than 2000 and most preferably more than 3000 μΩm, and a saturation magnetic flux density Bs above 1.2, preferably above 1.4 and most preferably above 1.6 T. Further, the coercivity shall be below 300 A/m, preferably below 280 A/m, most preferably below 250 A/m and DC-bias not less than 50% at 4000 A/m.

EXAMPLES

The following example is intended to illustrate particular embodiments and not to limit the scope of the invention.

Example 1

A pure water atomized iron powder having a content of iron above 99.5% by weight was used as the core particles. The mean particle size of the iron-powder was about 45 μm. The iron-powder was treated with a phosphorous containing solution according to U.S. Pat. No. 6,348,265. The obtained dry phosphorous coated iron powder was further mixed with kaolin and sodium silicate according to the following table 1. After drying at 120° C. for 1 hour in order to obtain a dry powder, the powder was mixed with 0.6% Kenolube® and compacted at 800 MPa into rings with an inner diameter of 45 mm, an outer diameter of 55 mm and a height of 5 mm. The compacted components were thereafter subjected to a heat treatment process at 530° C. or at 650° C. in a nitrogen atmosphere for 0.5 hours.

The specific resistivity of the obtained samples was measured by a four point measurement. For maximum permeability, $\mu_{max}$, and coercivity measurements the rings were "wired" with 100 turns for the primary circuit and 100 turns for the secondary circuit enabling measurements of magnetic properties with the aid of a hysteresisgraph, Brockhaus MPG 100. For core loss the rings were "wired" with 30 turns for the primary circuit and 30 turns for the secondary circuit with the aid of Walker Scientific Inc. AMH-401POD instrument.

When measuring incremental permability the rings were wounded with a third winding supplying a DC-bias current of 4 000 A/m. DC-bias were expressed as percentage of maximum incremental permeability.

Unless otherwise stated all tests in the following examples were performed accordingly.

In order to show the impact of presence of kaolin and sodium silicate in the second coating on the properties of the compacted and heat treated component, samples A-D were prepared according to table 1 which also shows results from testing of the components. Samples A-C are comparative examples and sample D is according to the invention.

TABLE 1

| | Additives | | | Component properties | | | | | | |
|---|---|---|---|---|---|---|---|---|---|---|
| | | | | | DC-Bias | | | Core loss | Core loss | Induction |
| Sample | wt-% Kaolin | wt-% Sodium silicate | Heat treatment temperature | Resistivity [μΩ · m] | @4000 A/m [%] | μmax [—] | Coercivity [A/m] | at 0.05 T 35 kHz [W/kg] | at 0.1 T 10 kHz [W/kg] | Bs@ 10 kHz [T] |
| A comp. | — | — | 530° C. | 8000 | 40 | 203 | 306 | 26 | 25 | 2.01 |
| A comp. | — | — | 650° C. | 1 | 20 | 190 | 220 | 109 | 52 | 2.00 |
| B comp. | 2% | — | 530° C. | 3000 | 60 | 85 | 422 | 37 | 38 | 1.85 |
| B comp. | 2% | — | 650° C. | 10 | 30 | 80 | 420 | 110 | 50 | 1.85 |
| C comp. | — | 0.4% | 650° C. | 10 | 30 | 199 | 211 | 60 | 58 | 1.89 |
| D inv. | 2% | 0.4% | 650° C. | 20000 | 75 | 97 | 222 | 22 | 22 | 1.85 |

As can be seen from table 1 the combination of kaolin and sodium silicate considerably improves resistivity and hence lowers core losses. DC-bias of 75% is obtained in the example according to the invention as compared to DC-bias of 30-60% in the comparative examples.

Example 2

To illustrate the importance of using a phosphorous coated pure iron powder together with the second coating, sample D as described above was compared with a similar sample E with the exception that sample E was made from a non-phosphoric solution treated iron base powder. Heat treatment was performed at 650° C. in nitrogen.

TABLE 2

| | | | | Component properties | | | | | | |
|---|---|---|---|---|---|---|---|---|---|---|
| | Additives | | | | DC-Bias | | | Core loss | Core loss | |
| Sample | P-coating | wt-% Kaolin | wt-% Sodium silicate | Resistivity [μΩ · m] | @4000 A/m [%] | μmax [—] | Coercivity [A/m] | at 0.05 T 35 kHz [W/kg] | at 0.1 T 10 kHz [W/kg] | Bs@ 10 kHz [T] |
| D inv. | Yes | 2% | 0.4% | 20000 | 75 | 97 | 222 | 22 | 22 | 1.85 |
| E comp. | No | 2% | 0.4% | 200 | 60 | 113 | 230 | 30 | 31 | 1.86 |

As can be seen from table 2 it is advantageous that the iron powder is coated with a phosphorous containing layer before applying the second layer.

Example 3

This example shows that the dual coating concept according to the invention may be applied to different particle sizes of the iron powder while still obtaining the desired effect. For sample F) an iron powder having a mean particle size of ~45 μm has been used, for sample G) an iron powder having a mean particle size of ~100 μm has been used and for sample H) an iron powder having a mean particle size of ~210 μm has been used. The powders were coated with a first phosphorous containing layer. Thereafter some samples were further treated with 1% kaolin and 0.4% sodium silicate as earlier described. Heat treatment was performed at 650° C. in nitrogen. Results from testing of samples F-H with and without the second layer, are shown in table 3.

TABLE 3

| | | | Component properties | | | | | | |
|---|---|---|---|---|---|---|---|---|---|
| | Additives | | | DC-Bias | | | Core loss | Core loss | |
| Sample | wt-% Kaolin | wt-% Sodium silicate | Resistivity [μΩ · m] | @4000 A/m [%] | μmax [—] | Coercivity [A/m] | at 0.05 T 35 kHz [W/kg] | at 0.1 T 10 kHz [W/kg] | Bs@ 10 kHz [T] |
| F inv. | 1% | 0.4% | 15000 | 70 | 104 | 226 | 21 | 21 | 1.90 |
| Sample F only first layer. Comp. | — | — | 1 | 20 | 190 | 230 | 109 | 52 | 2.01 |
| G inv. | 1% | 0.4% | 19000 | 55 | 130 | 177 | 31 | 30 | 1.92 |
| Sample G only first layer comp. | — | — | 1 | 15 | 260 | 180 | 151 | 72 | 2.03 |
| H inv. | 1% | 0.4% | 35000 | 40 | 135 | 140 | 40 | 40 | 1.94 |
| Sample H only first layer comp. | — | — | 1 | 10 | 554 | 140 | 200 | 80 | 2.08 |

Table 3 shows that regardless of the particle size of the iron powder huge improvements of resistivity, core losses and DC-bias are obtained for components according to the present invention.

Example 4

Example 4 illustrates that it is possible to use different types of water glass and different types of clays containing defined phyllosilicates. The powders were coated as described above with the exception that a various silicates (Na, K and Li) and various clays, kaolin and talc, containing phyllosilicates having electroneutral layers were used. In comparative examples clays containing phyllosilicates having electrical charged layer, Veegum® and a mica, were used. Veegum® is the trade name of a clay from the smectite group containing the mineral montmorillonit. The mica used was muscovite. The second layer in all the tests contained 1% of clay and 0.4wt-% of water glass. Heat treatment was performed at 650° C. in nitrogen.

The following table 4 shows results from testing of the components.

TABLE 4

| | Additives | | | Component properties | | | | | | |
|---|---|---|---|---|---|---|---|---|---|---|
| | | | | | DC-Bias @4000 | | | Core loss at 0.05 T | Core loss at 0.1 T | Bs@ |
| Sample | Type of clay | Type of silicate | Mol ratio silicate | Resistivity [μΩ · m] | A/m [%] | μmax [—] | Coercivity [A/m] | 35 kHz [W/kg] | 10 kHz [W/kg] | 10 kHz [T] |
| I inv. | Kaolin | Na | 2.5 | 15000 | 70 | 118 | 213 | 21 | 21 | 1.90 |
| J inv. | Talc | Na | 2.5 | 15000 | 55 | 143 | 211 | 22 | 21 | 1.93 |
| K comp. | Veegum ® | Na | 2.5 | 20 | 55 | 137 | 213 | 31 | 30 | 1.90 |
| L comp. | Mica | Na | 2.5 | 80 | 40 | 175 | 219 | 34 | 32 | 1.95 |
| M inv. | Kaolin | Na | 2.32 | 15000 | 65 | 125 | 217 | 20 | 20 | 1.90 |
| N inv. | Kaolin | K | 3.37 | 18000 | 65 | 128 | 223 | 24 | 24 | 1.91 |
| O inv. | Kaolin | Li | 2.5 | 16000 | 75 | 110 | 235 | 23 | 23 | 1.89 |

As evident from table 4 various types of water glass and clays containing defined phyllosilicates can be used provided the phyllosilicate is of the type having elctroneutral layers.

Example 5

Example 5 illustrates that by varying the amounts of clay and alkaline silicate in the second layer the properties of the compacted and heat treated component can be controlled and optimized. The samples were prepared and tested as described earlier. For transverse rupture strength samples were manufacture and tested according to SS-ISO 3325. Heat treatment was performed at 650° C. in nitrogen atmosphere.

The following table 5 shows results from testing.

TABLE 5

| | Additives | | Component properties | | | | | | | |
|---|---|---|---|---|---|---|---|---|---|---|
| | | | Transverse rupture | | DC-Bias @4000 | | | Core loss at 0.05 T | Core loss at 0.1 T | Bs@ |
| Sample | Kaolin wt-% | Silicate wt-% | strength TRS [MPa] | Resistivity [μΩ · m] | A/m [%] | μmax [—] | Coercivity [A/m] | 35 kHz [W/kg] | 10 kHz [W/kg] | 10 kHz [T] |
| P comp. | — | 0.4 | 55 | 1 | 30 | 199 | 211 | 60 | 58 | 1.96 |
| Q inv. | 0.5 | 0.4 | 43 | 3000 | 65 | 134 | 217 | 22 | 21 | 1.93 |
| R inv. | 1 | 0.2 | 35 | 5000 | 66 | 134 | 213 | 23 | 22 | 1.92 |
| S inv. | 1 | 0.3 | 35 | 10000 | 68 | 130 | 211 | 22 | 22 | 1.90 |
| T inv. | 1 | 0.4 | 30 | 15000 | 75 | 118 | 213 | 21 | 21 | 1.90 |
| U inv. | 1 | 0.6 | 29 | 12000 | 75 | 115 | 212 | 23 | 21 | 1.89 |
| V inv. | 1 | 0.8 | 29 | 10000 | 77 | 110 | 226 | 22 | 23 | 1.88 |
| W comp. | 1 | 1 | 31 | 500 | 75 | 116 | 201 | 21 | 22 | 1.86 |
| X comp. | 1 | 1.2 | 30 | 200 | 70 | 122 | 211 | 21 | 21 | 1.89 |
| Y comp. | 2 | — | 20 | 3000 | 65 | 85 | 242 | 30 | 29 | 1.85 |
| Z inv. | 2 | 0.4 | 24 | 20000 | 75 | 97 | 222 | 22 | 22 | 1.85 |
| Aa inv. | 2 | 0.8 | 24 | 15000 | 78 | 80 | 253 | 24 | 23 | 1.80 |
| Bb inv. | 3 | 0.4 | 18 | 25000 | 70 | 120 | 222 | 24 | 25 | 1.80 |
| Cc inv. | 5 | 0.4 | 8 | 10000 | 60 | 160 | 234 | 32 | 31 | 1.70 |

As can be seen from table 5 if the content of sodium silicate in the second layer exceeds 0.9% by weight, resistivty will decrease. Resistivity also decreases with decreasing content of sodium silicate, thus the content of silicate shall be between 0.1-0.9% by weight, preferably between 0.2-0,8% by weight of the total iron-based composite powder. Further increased clay content in the second layer up to about 4% will increase resistivity but decrease core loss due to increased coercivity, decreased TRS, induction and DC-bias. Thus, the content of clay in the second layer should be kept below 5%, preferably below 4% by weight of the iron-based composite powder. The lower limit for content of clay is 0.2%, preferably 0.4% as a too low content of clay will have a detrimental influence of resistivty, core loss and DC-bias.

Example 6

The following example 6 illustrates that components produced from powder according to the invention can be heat treated in different atmospheres. The samples below have been treated as described above, the content of kaolin in the second layer was 1% and the content of sodium silicate was 0.4% by weight of the composite iron powder. The samples Dd and Ee were heat treated at 650° C. in nitrogen and air respectively. Results from testing are shown in table 6.

TABLE 6

| | | Component properties | | | | | | | |
|---|---|---|---|---|---|---|---|---|---|
| Sample | Heat treatment atmosphere | Transverse rupture strength TRS [MPa] | Resistivity [μΩ · m] | DC-Bias @4000 A/m [%] | μmax [—] | Coercivity [A/m] | Core loss at 0.05 T 35 kHz [W/kg] | Core loss at 0.1 T 10 kHz [W/kg] | Bs@10 kHz [T] |
| Dd | Nitrogen | 30 | 15000 | 77 | 118 | 206 | 21 | 21 | 1.88 |
| Ee | Air | 35 | 12000 | 72 | 131 | 240 | 24 | 23 | 1.88 |

Table 6 shows that high resistivity, low core losses, high induction and good DC-bias are obtained for components according to the invention heat treated at 650° C. regardless of whether they are heat treated in nitrogen atmosphere or in air.

The invention claimed is:

1. A composite iron-based powder comprising core particles coated with a first phosphorous containing layer and a second layer containing an alkaline silicate combined with a clay mineral containing a phyllosilicate the combined silicon-oxygen tetrahedral layer and hydroxide octahedral layers thereof being electrical neutral; wherein the phosphorous containing layer has a thickness between 20 and 300 nm.

2. A composite iron-based powder according to claim 1, wherein the phosphorous containing layer is provided by contacting the core particles with a phosphorous compound in a solvent and afterwards removing the solvent by drying.

3. A composite iron-based powder according to claim 2, wherein the phosphorous compound is phosphoric acid or ammonium phosphate.

4. The composite iron base powder according to claim 1, wherein the core particles are iron particles having an iron-content above 99.5% by weight.

5. The composite iron base powder according to claim 1, wherein the content of alkaline silicate is between 0.1-0.9% by weight of the composite iron based powder.

6. The composite iron base powder according to claim 1, wherein the content of clay is between 0.2-5% by weight of the composite iron- based powder.

7. The composite iron base powder according to claim 1, wherein the alkaline silicate is chosen from the group consisting of a sodium silicate, potassium silicate and a lithium silicate and the molar ratios thereof is between 1.5-4.

8. The composite iron base powder according to claim 1, wherein the clay is chosen from the group consisting of kaolin and talc.

9. The composite iron-based powder according to claim 1, wherein the core particles have a mean particle size between 20-300 μm.

10. A method for producing a compacted and heat treated component comprising the steps of:

a) providing a coated iron powder comprising core particles coated with a first phosphorous containing layer and a second layer containing an alkaline silicate combined with a clay mineral containing a phyllosilicate the combined silicon-oxygen tetrahedral layer and hydroxide octahedral layers thereof being electrical neutral;

b) compacting the coated iron powder, optionally mixed with a lubricant, in a uniaxial press movement in a die at a compaction pressure between 400 and 1200 Mpa;

c) ejecting the compacted component form the die; and d) heat treating the ejected component in a non-reducing atmosphere at a temperature up to 700° C.

11. A component produced according to the method described in claim 10.

12. An inductor core produced according to claim 10, having a resistivity, ρ, above 1000 μΩm;

a saturation magnetic flux density Bs above 1.2 T;

a core loss less than 28 W/kg at a frequency of 10 kHz and induction of 0.1 T; and coercivity shall be below 300 A/m and DC-bias not less than 50% at 4000 A/m.

13. A method for producing a compacted and heat treated component comprising the steps of:

a) providing a coated iron powder according to claim 1;

b) compacting the coated iron powder, optionally mixed with a lubricant, in a uniaxial press movement in a die at a compaction pressure between 400 and 1200 Mpa;

c) ejecting the compacted component form the die; and d) heat treating the ejected component in a non-reducing atmosphere at a temperature up to 700° C.

14. A component produced according to the method described in claim 13.

15. An inductor core produced according to claim 13, having a resistivity, ρ, above 1000 μΩm;

a saturation magnetic flux density Bs above 1.2 T;

a core loss less than 28 W/kg at a frequency of 10 kHz and induction of 0.1 T; and coercivity shall be below 300 A/m and DC-bias not less than 50% at 4000 A/m.

* * * * *